US006863074B2

(12) United States Patent
Xue et al.

(10) Patent No.: US 6,863,074 B2
(45) Date of Patent: Mar. 8, 2005

(54) CIGARETTE FILTERS COMPRISING UNFUNCTIONALIZED POROUS POLYAROMATIC RESINS FOR REMOVING GAS PHASE CONSTITUENTS FROM MAINSTREAM TOBACCO SMOKE

(75) Inventors: Lixin Xue, Midlothian, VA (US); Charles Edwin Thomas, Jr., Richmond, VA (US); Liqun Yu, Midlothian, VA (US); Kent B. Koller, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 10/231,017

(22) Filed: Aug. 30, 2002

(65) Prior Publication Data

US 2004/0040565 A1 Mar. 4, 2004

(51) Int. Cl.[7] ..... A24F 1/20

(52) U.S. Cl. ..... 131/207; 131/202; 131/342; 131/331

(58) Field of Search ..... 131/207, 331, 131/334, 341, 342, 344, 202, 203, 201

(56) References Cited

U.S. PATENT DOCUMENTS

| | | | | |
|---|---|---|---|---|
| 2,754,829 A | | 7/1956 | Hess | |
| 2,815,760 A | | 12/1957 | Schreus et al. | |
| 3,093,144 A | | 6/1963 | Van Buuren | |
| 3,217,719 A | | 11/1965 | Spears et al. | |
| 3,253,967 A | | 5/1966 | Blakey et al. | |
| 3,311,115 A | | 3/1967 | Mueller et al. | |
| 3,312,226 A | | 4/1967 | Bavley et al. | |
| 3,403,202 A | | 9/1968 | Green et al. | |
| 3,499,452 A | | 3/1970 | Kallianos et al. | |
| 4,033,361 A | * | 7/1977 | Horsewell et al. | 131/262 A |
| 4,054,550 A | | 10/1977 | Parker et al. | |
| 4,059,121 A | | 11/1977 | Brackmann et al. | |
| 4,156,431 A | | 5/1979 | Epstein et al. | |

(List continued on next page.)

FOREIGN PATENT DOCUMENTS

| | | |
|---|---|---|
| GB | 588079 | 5/1947 |
| GB | 725764 | 3/1955 |
| GB | 858864 | 1/1961 |
| GB | 908185 | 10/1962 |
| GB | 1097748 | 1/1968 |
| GB | 1100727 | 1/1968 |
| WO | WO 96/39054 | 12/1996 |

OTHER PUBLICATIONS

Written Opinion for PCT/US03/26745 dated Aug. 10, 2004.
Charles E. Thomas et al., Puff–by Puff Mainstream Smoke Analysis by Multiplex Gas Chromatography–Mass Spectrometry, Beitrage Zur Tabakforschung International, Contributions to Tobacco Research, vol. 19–No. 7, Oct. 2001, ppgs 345–351, Philip Morris USA.
Notification of Transmittal of the International Search Report or the Declaration dated Apr. 13, 2004 for PCT/US03/26745.

*Primary Examiner*—Dionne A. Walls
(74) *Attorney, Agent, or Firm*—Burns, Doane, Swecker & Mathis, L.L.P.

(57) ABSTRACT

Cigarette filters, methods for making cigarettes and methods for smoking cigarettes are provided, which involve the use of an unfunctionalized porous polyaromatic resins, which is capable of removing at least some of at least one gas phase constituent from mainstream smoke through sorption. The unfunctionalized porous polyaromatic resin may be a polymerization product of non-polar styrene and divinyl benzene. Various gas phase constituent can be removed from mainstream tobacco smoke, such as dienes, furans, pyrroles, aromatics and ketones, for example. The cigarette filters and cigarettes can provide low resistance-to-draw and/or high total particulate matter delivery. Additionally, the unfunctionalized porous polyaromatic resin may further include flavorant(s).

32 Claims, 7 Drawing Sheets

U.S. PATENT DOCUMENTS

| | | | |
|---|---|---|---|
| 4,202,356 | A | 5/1980 | Digenis et al. |
| 4,226,250 | A | 10/1980 | Ehrenpreis et al. |
| 4,700,723 | A | 10/1987 | Yoshikawa et al. |
| 5,191,905 | A | 3/1993 | Tsukamoto |
| 5,204,376 | A | 4/1993 | Henmi et al. |
| 5,509,430 | A | 4/1996 | Berger |
| 5,538,019 | A | 7/1996 | Bullwinkel et al. |
| 5,570,707 | A | 11/1996 | Hill |
| 5,692,525 | A | 12/1997 | Counts et al. |
| 5,817,159 | A | 10/1998 | Cahill et al. |
| 5,911,224 | A | 6/1999 | Berger |
| 5,998,500 | A | 12/1999 | Cahill et al. |
| 6,062,228 | A | 5/2000 | Loercks et al. |
| 6,119,699 | A | 9/2000 | Sung |
| 2003/0066539 | A1 * | 4/2003 | Figlar ..... 131/344 |

* cited by examiner

- Carbon-Pica G 277 20X50 mesh
- Silica Gel-Grace Davison Grade 646, 35x60 mesh
- Polyaromatic Resins-XAD-16hp, 20-60 mesh Some Physical Parameters of Cigarette Samples with PSP Adsorbent Filters

| Adsorbent | Carbon | Silica Gel | XAD-16 | 1R4F Average/Sigma | |
|---|---|---|---|---|---|
| RTD/mm H2O | 155 | 177 | 130 | 140 | 7 |
| Dilution% | 22 | 23 | 24 | 30 | 4 |
| Adsorbent/mg | 102 | 76 | 102 | 0 | 0 |
| Surf. Area, $m^2/g$ | ~1590 | 275-375 | 800 | | |
| CA Replaced/mg | -25 | -23 | -15 | 0 | 0 |

1a)-Type I

1b)-Type II

1c)-Type III

1d)-Type IV

CIGARETTE FILTERS COMPRISING UNFUNCTIONALIZED POROUS POLYAROMATIC RESINS FOR REMOVING GAS PHASE CONSTITUENTS FROM MAINSTREAM TOBACCO SMOKE

FIELD OF INVENTION

The invention relates generally to lowering gas phase constituents in mainstream tobacco smoke. More specifically, the invention relates to cigarettes, cigarette filters, as well as methods for making cigarette filters and cigarettes, which involve the use of unfunctionalized porous polyaromatic resins.

BACKGROUND OF THE INVENTION

Certain filter materials have been suggested for incorporation into cigarette filters, including cotton, paper, cellulose, and certain synthetic fibers. However, such filter materials generally only remove particulate and condensable constituents from tobacco smoke. Thus, they are usually not optimal for the removal of certain gaseous constituents from tobacco smoke, e.g., gas phase constituents or volatile organic compounds. Also, certain materials when placed in cigarette filters will non-selectively remove constituents in mainstream tobacco smoke, and may thus yield a product with undesirable taste.

Further, certain materials remove constituents from mainstream smoke through chemical or catalytic reaction. For example, U.S. Pat. No. 6,119,699 describes certain functionalized silica or resin particles and U.S. Pat. No. 5,204,376 describes an anion exchanger that is functionalized with a specific diamine group. U.S. Pat. No. 4,202,356 describes a smoke filter containing an imidazole-containing polymer, where the imidazole groups are chemically bound to the polymer. U.S. Pat. No. 4,156,431 describes an unsulfonated cross-linked polystyrene. U.S. Pat. No. 4,059,121 describes a thermoplastic polymeric non-absorbent material. U.S. Pat. No. 4,033,361 describes a tobacco-smoke filter, which contains, as adsorbent for volatile tobacco-smoke constituents, a macroporous amine-type anion-exchange resin which contains substantially primary amino groups. U.S. Pat. No. 3,217,719 describes certain functionalized polymeric compounds that form a complex with phenol and phenolic compounds.

U.S. Pat. No. 4,700,723 describes certain tobacco filters with fibrous ion exchange resins, which are said to have ion exchange ability through the introduction of cation or anion exchange groups or chelating groups to polymers. Similarly, U.S. Pat. No. 4,226,250 describes a cation exchange material. U.S. Pat. No. 3,093,144 describes tobacco filters containing an ion exchange resin including aromatic groups, that are able to bind nicotine and the tarry constituents of tobacco smoke and U.S. Pat. No. 2,815,760 describes tobacco smoke filters for selective removal of certain constituents of mainstream smoke, which include ion exchange materials, along with other additional materials to chemically react with certain constituents of mainstream smoke. U.S. Pat. No. 2,754,829 describes filters containing an ion exchange material, such as a hydrogen exchanging cation exchanger. Other filters are described in U.S. Pat. Nos. 5,998,500; 5,817,159; and 5,570,707, as well as British Patent Nos. 1,100,727; 1,097,748; 908,185; 858,864; and 588,079.

Yet, despite the developments to date, there remain various shortcomings and drawbacks to many of the existing materials for cigarette filters. For example, it may be advantageous to avoid certain chemical and/or catalytic reactions that affect taste. Additionally, many of these materials may not be able to remove gas phase constituents from mainstream tobacco smoke.

Thus, there remains a continued interest in improved and more efficient methods and compositions for lowering certain gas phase constituents in the mainstream smoke of a cigarette during smoking. Preferably, such methods and compositions should not involve expensive or time consuming manufacturing and/or processing steps.

SUMMARY

The invention relates generally to removing ceratin gas phase constituents from mainstream tobacco smoke. In particular, the invention relates to cigarette filters, methods for making cigarettes, methods for making cigarette filters, and methods for smoking cigarettes which involve the use of unfunctionalized porous polyaromatic resins.

In an embodiment, the invention relates to cigarette filters comprising an unfunctionalized porous polyaromatic resin, wherein the unfunctionalized porous polyaromatic resin is capable of removing at least some of at least one gas phase constituent from mainstream smoke through sorption. In a preferred embodiment, the unfunctionalized porous polyaromatic resins have high surface area. The unfunctionalized porous polyaromatic resin preferably has a surface area of at least 500 $m^2$/gram, at least 750 $m^2$/gram, at least 1000 $m^2$/gram, or at least 1500 $m^2$/gram. In one embodiment of the invention, the unfunctionalized porous polyaromatic resin has a mean pore diameter from about 20 Å to about 1000 Å, or a pore volume from about 0.1 mL/g to about 2.0 mL/g.

Preferably, the unfunctionalized porous polyaromatic resin is a polymerization product of non-polar styrene and divinyl benzene. Also preferably, the unfunctionalized porous polyaromatic resin is more hydrophobic than activated carbon.

In an embodiment of the invention, the unfunctionalized porous polyaromatic resin is provided in the form of beads that are from about 50 $\mu$m to about 3000 $\mu$m in size, from about 100 $\mu$m to about 2500 $\mu$m in size, or from about 250 $\mu$m to about 1500 $\mu$m in size.

In yet another embodiment of the invention, the at least one gas phase constituent is selected from the group consisting of dienes, furans, pyrroles, aromatics and ketones. For example, the at least one gas phase constituent may be selected from the group including, but not limited to, propene, hydrogn cyanide, propadiene, 1,3-butadiene, isoprene, cyclopentadiene, 1,3-cyclohexadiene, methyl cyclopentadiene, formaldehye, acetaldehyde, acrolein, acetone, diacetyl, methyl ethyl ketone, cyclopentanone, benzene, toluene, acrylonitrile, methyl furan, 2,5-dimethyl furan, hydrogen sulfide, carbonyl sulfide, methyl mercaptan, and 1-methyl pyrrole. Preferably, the at least one gas phase constituent is selected from the group consisting of formaldehyde, acetaldehyde, acrolein, methanol, hydrogen sulfide, carbonyl sulfide and methyl mercaptan.

In yet another embodiment, the unfunctionalized porous polyaromatic resin selectively removes one or more constituents from mainstream smoke, but not others. For example, the unfunctionalized porous polyaromatic resin can selectively remove formaldehyde, acetaldehyde, acrolein and methanol from mainstream tobacco smoke. Alternatively, the unfunctionalized porous polyaromatic resin may selectively remove hydrogen sulfide, carbonyl sulfide and methyl mercaptan from mainstream tobacco smoke.

In an embodiment of the invention, the unfunctionalized porous polyaromatic resin is present in an amount effective to remove at least 50% of at least one gas phase constituent in mainstream tobacco smoke. Preferably, the cigarette filter comprises from about 5 mg to about 300 mg of the unfunctionalized porous polyaromatic resin or from about 75 mg to about 225 mg of the unfunctionalized porous polyaromatic resin.

In yet another embodiment of the invention, the cigarette filter has low resistance-to-draw and/or high total particulate matter delivery. In a preferred embodiment, the unfunctionalized porous polyaromatic resin may further comprises at least one flavorant.

The invention also relates to cigarette filters comprising the unfunctionalized porous polyaromatic resin as described above, wherein the filter is attached to a tobacco rod by tipping paper. The unfunctionalized porous polyaromatic resin may be incorporated in one or more cigarette filter parts selected from the group consisting of tipping paper, shaped paper insert, a plug, a space, or a free-flow sleeve. The filter may be selected from the group consisting of: a mono filter, a dual filter, a triple filter, a cavity filter, a recessed filter and a free-flow filter, as well as any other suitable filter design.

In an embodiment, the invention also relates to cigarettes comprising the cigarette filter.

The invention also relates to methods for making cigarette filters, comprising incorporating an unfunctionalized porous polyaromatic resin into a cigarette filter, wherein the unfunctionalized porous polyaromatic resin is capable of removing at least some of at least one constituent in mainstream tobacco smoke through sorption.

In yet another embodiment, the invention also relates to methods for making cigarettes, comprising: (i) providing a cut filler to a cigarette making machine to form a tobacco rod; (ii) placing a paper wrapper around the tobacco rod; and (iii) attaching a cigarette filter comprising an unfunctionalized porous polyaromatic resin to the tobacco rod using tipping paper to form the cigarette.

The invention also relates to methods of smoking cigarettes comprising unfunctionalized porous polyaromatic resins, which comprise lighting the cigarette to form smoke and drawing the smoke through the cigarette, wherein during the smoking of the cigarette, the unfunctionalized porous polyaromatic resin removes at least some of at least one constituent in mainstream tobacco smoke.

BRIEF DESCRIPTION OF THE DRAWINGS

Various features and advantages of the invention will become apparent from the following detailed description of the preferred embodiments thereof in connection with the accompanying drawings, in which.

DETAILED DESCRIPTION OF THE INVENTION

Figure 1:
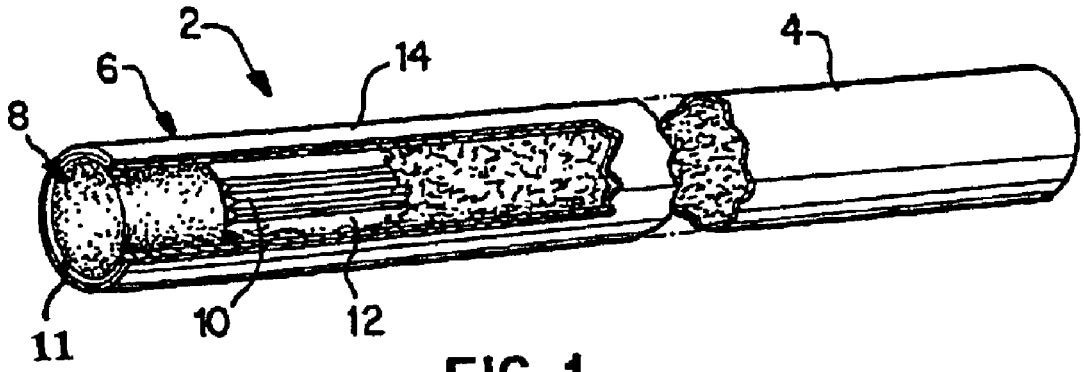
FIG. 1 is a partially exploded perspective view of a cigarette incorporating one embodiment of the present invention wherein folded paper containing an unfunctionalized porous polyaromatic resin is inserted into a hollow portion of a tubular filter element of the cigarette.

The invention relates generally to removing ceratin gas phase constituents from mainstream tobacco smoke. In particular, the invention relates to cigarette filters, methods for making cigarettes and methods for smoking cigarettes which involve the use of unfunctionalized porous polyaromatic resins. Among the advantages of the unfunctionalized porous polyaromatic resins is the ability to easily manufacture such materials to better controlled and/or more uniform specifications than materials such as carbon, for example. In addition, the unfunctionalized porous polyaromatic resins are readily and commercially available, do not impart any off-taste to the mainstream smoke, and can be easily tailored to a variety of specifications.

The unfunctionalized porous polyaromatic resins are commercially available from suppliers such as Mitsubishi, Dow Chemical and/or Rohm and Haas. Such resins have been developed extensively for use in gas chromatographic applications, and can be produced uniformly in very large scale and with high yields. For example, polymeric resins such as Amberlite (XAD-4, XAD-16hp), DIAION (SP-825L, SP-850), DOWEX (I-493, V-493, V-502) may be used.

The unfunctionalized porous polyaromatic resins are used to remove gas phase constituents from mainstream smoke through sorption. As used herein, the terms "constituent,"

"compound" and "component" are used interchangeably herein to refer to various gases or organic compounds found in tobacco smoke. The term "sorption" denotes filtration through absorption and/or adsorption. Sorption is intended to cover interactions on the surfaces of the unfunctionalized porous polyaromatic resin, as well as interactions within the pores and channels of the unfunctionalized porous polyaromatic resin. In other words, the unfunctionalized porous polyaromatic resin may condense or hold molecules of the gas phase constituent on its surface and/or take up the gas phase constituent in bulk, i.e. through penetration of the other substance into its inner structure or into its pores, or through physical sieving, i.e. capture of certain constituents in the pores of the unfunctionalized porous polyaromatic resin.

The term "mainstream" smoke includes the mixture of gases, vapors and particulates passing through a smoking mixture and issuing through the filter end, i.e., the smoke issuing or drawn from the mouth end of a smoking article for example during smoking of a cigarette. The gas phase constituents, which are present in agglomerates or molecular forms, are generally much smaller in size than the particulate matter of mainstream tobacco smoke. In order to remove the smaller gas phase constituents of mainstream tobacco smoke, the unfunctionalized porous polyaromatic resins must have sufficiently high surface area.

Examples of gas phase constituents to be removed from mainstream tobacco smoke include, but are not limited to various dienes, furans, pyrroles, aromatics and ketones. Specific examples of constituents include propene, hydrogn cyanide, propadiene, 1,3-butadiene, isoprene, cyclopentadiene, 1,3-cyclohexadiene, methyl cyclopentadiene, formaldehye, acetaldehyde, acrolein, acetone, diacetyl, methyl ethyl ketone, cyclopentanone, benzene, toluene, acrylonitrile, methyl furan, 2,5-dimethyl furan, hydrogen sulfide, carbonyl sulfide, methyl mercaptan, and 1-methyl pyrrole.

The unfunctionalized porous polyaromatic resins can also be modified in terms of their mean pore diameter distribution, surface area, surface chemical properties, pore structures, and/or particle sizes to selectively remove one or more constituents from mainstream smoke. By "selective removal" is meant that certain constituents are substantially removed from mainstream smoke, while other constituents are not substantially removed. The term "selective" also encompasses preferential removal of certain constituents from mainstream smoke, i.e. where more than one constituent may be removed, but where one constituent is removed to a greater extent than another constituent.

For example, it has been found that resins such as DOWEX™ (L-493, V-493, V-502) can selectively remove formaldehyde, acetaldehyde, acrolein and methanol from mainstream tobacco smoke, to a greater extent than other constituents are removed. It has also been found that DIAION™ (SP-825L, SP-850) can selectively remove hydrogen sulfide, carbonyl sulfide and methyl mercaptan from mainstream tobacco smoke, to a greater extent than other constituents are removed.

In order to remove the smaller gas phase constituents of mainstream tobacco smoke, the unfunctionalized porous polyaromatic resins must have sufficiently high surface area. The unfunctionalized porous polyaromatic resin preferably has a surface area of at least 500 $m^2$/gram, at least 750 $m^2$/gram, at least 1000 $m^2$/gram, or at least 1500 $m^2$/gram. In one embodiment of the invention, the unfunctionalized porous polyaromatic resin has a mean pore diameter from about 20 Å to about 1000 Å and/or a pore volume from about 0.1 mL/g to about 2.0 mL/g.

In a preferred embodiment, the cigarette filters have low resistance to draw (RTD) and high total particulate matter (TPM) delivery. As shown in Tables 1–3, all the modified 1R4F-cigarette filters using polyaromatic resin beads under plug/space/plug (PSP) configurations have lower RTD than that of carbon or silica gel filters. These may result from the spherical uniform shape of the polyaromatic resin beads, which allowed favorable space between particles for the tobacco smoke stream to pass through.

In yet another embodiment of the invention, the cigarette filter has low resistance-to-draw and/or high total particulate matter delivery. The RTD and the gas phase filtration performance of the formed filters may be optimized by adjusting the particle sizes of the resin beads. For example, V-493 resin (250–850 $\mu$m in particle diameter) is the smaller particle size version of V-502 resin (1500 $\mu$m in particle diameter), which shows much greater gas phase filtration efficiency for almost all of the gas phase constituents studied with slightly increased RTD. The smaller the beads, the shorter the diffusion path for the gas phase compounds to diffuse into the beads, and the higher the filtration efficiency. However, the filtration efficiency should also be optimized such that a suitable RTD is achieved. If the RTD is too high, efficient delivery of TPM can be compromised, especially when using very small resin beads. The resin beads can have the same or different sizes when incorporated in the cigarette filter. In an embodiment of the invention, the unfunctionalized porous polyaromatic resin is provided in the form of beads that are from about 50 $\mu$m to about 3000 $\mu$m in size, from about 100 $\mu$m to about 2500 $\mu$m in size, or from about 250 $\mu$m to about 1500 $\mu$m in size.

In an embodiment of the invention, the unfunctionalized porous polyaromatic resin is present in an amount effective to remove at least 50% of at least one gas phase constituent in mainstream tobacco smoke. For example, a cigarette filter may comprise from about 5 mg to about 300 mg of the unfunctionalized porous polyaromatic resin or from about 75 mg to about 225 mg of the unfunctionalized porous polyaromatic resin.

In a preferred embodiment, the unfunctionalized porous polyaromatic resin may further comprise at least one flavorant. Any suitable flavorant may be used. Examples of flavorants include, but are not limited to, menthol, licorice, clove, anise, cinnamon, sandalwood, geranium, rose oil, vanilla, lemon oil, cassia, spearmint, fennel, ginger, and the like. The flavorant also can be in the form of a flavorant-release compound, such as the carbonate esters disclosed in U.S. Pat. Nos. 3,312,226 and 3,499,452, which are hereby incorporated in their entirety.

Any suitable filter design may be used, including but not limited to a mono filter, a dual filter, a triple filter, a cavity filter, a recessed filter or a free-flow filter. Mono filters typically contain a variety of cellulose acetate tow or cellulose paper materials. Pure mono cellulose filters or paper filters offer good tar and nicotine retention, and are biodegradable. Dual filters can comprise a cellulose acetate mouth side and a pure cellulose segment or cellulose acetate segment, with an unfunctionalized porous polyaromatic resin on the smoking material or tobacco side. The length and pressure drop of the two segments of the dual filter can be adjusted to provide optimal adsorption, while maintaining acceptable draw resistance. Triple filters may have mouth and tobacco side segments, while the middle segment comprises a material or paper containing the unfunctionalized porous polyaromatic resin. Cavity filters have two segments, for example, acetate-acetate, acetate-paper or paper-paper, separated by a cavity containing the unfunctionalized porous polyaromatic resin. Recessed filters have an open cavity on the mouth side, and contain the unfunctionalized porous polyaromatic resin incorporated into the plug material. The filters may also optionally be ventilated, and/or comprise additional sorbents (such as charcoal, activated carbon and/or magnesium silicate), catalysts, flavorants or other additives for the cigarette filter.

In a preferred embodiment, the unfunctionalized porous polyaromatic resin may be incorporated as a shaped article, loose particles, or powder, preferably having a particle size of 20–60 mesh into a filter arrangement in the path of the smoke stream of a smoking article. The following descriptions illustrate various non-exhaustive embodiments of filters in accordance with the invention.

FIG. 1 illustrates a cigarette 2 having a tobacco rod 4, a filter portion 6, and a mouthpiece filter plug 8. An unfunctionalized porous polyaromatic resin can be loaded onto folded paper 10 inserted into a hollow cavity such as the interior of a free-flow sleeve 12 forming part of the filter portion 6.

Figure 2:
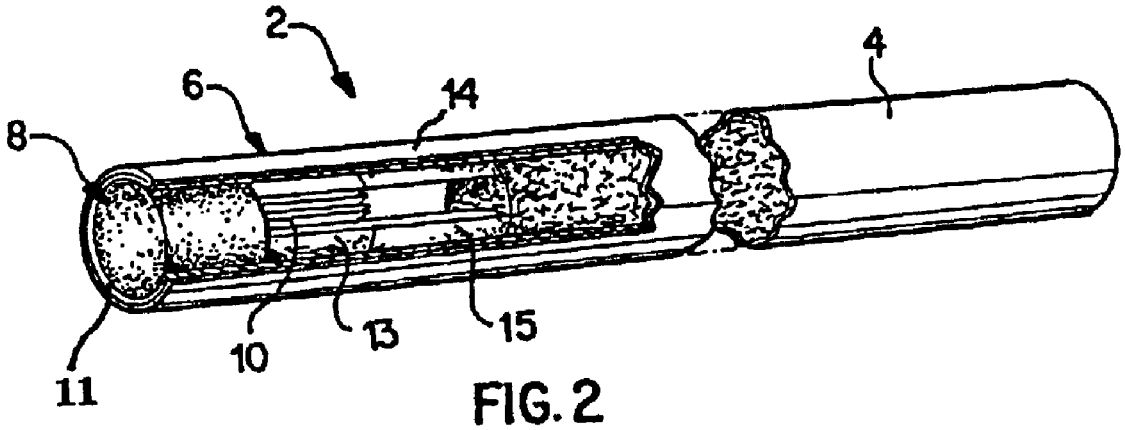
FIG. 2 is a partially exploded perspective view of another embodiment of the present invention wherein an unfunctionalized porous polyaromatic resin is incorporated in folded paper and inserted into a hollow portion of a first free-flow sleeve of a tubular filter element next to a second free-flow sleeve.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, a desired amount of the unfunctionalized porous polyaromatic resin can be provided in the cigarette filter portion by a combination of the coated amount of reagent/area of the paper and/or the total area of coated paper employed in the filter (e.g., higher amounts of unfunctionalized porous polyaromatic resin can be provided simply by using larger pieces of coated paper). In the cigarettes shown in FIGS. 1 and 2, the tobacco rod 4 and the filter portion 6 are joined together with tipping paper 14. In both cigarettes, the filter portion 6 may be held together by filter overwrap 11.

Unfunctionalized porous polyaromatic resin can be incorporated into the filter paper in a number of ways. For example, unfunctionalized porous polyaromatic resin can be mixed with water to form a slurry. The slurry can then be coated onto pre-formed filter paper and allowed to dry. The filter paper can then be incorporated into the filter portion of a cigarette in the manner shown in FIGS. 1 and 2. Alternatively, the dried paper can be wrapped into a plug shape and inserted into a filter portion of the cigarette. For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively, the unfunctionalized porous polyaromatic resin can be added to the filter paper during the papermaking process, if the particles are small enough, e.g. less than about 100 $\mu$m, preferably less than 25 $\mu$m. For example, unfunctionalized porous polyaromatic resin can be mixed with bulk cellulose to form a cellulose pulp mixture. The mixture can be then formed into filter paper according to any suitable method.

Figure 3:
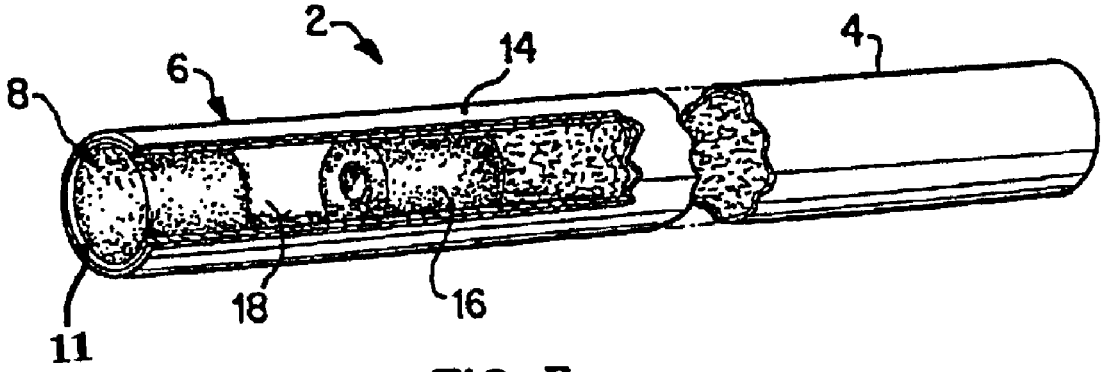
FIG. 3 is a partially exploded perspective view of another embodiment of the present invention wherein an unfunctionalized porous polyaromatic resin is incorporated in a plug-space-plug filter element.

In another preferred embodiment, unfunctionalized porous polyaromatic resin is incorporated into the fibrous material of the cigarette filter portion itself. Such filter materials include, but are not limited to, fibrous filter materials including paper, cellulose acetate fibers, and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14. The filter portion 6 may include a filter overwrap 11. The filter overwrap 11 containing traditional fibrous filter material and unfunctionalized porous polyaromatic resin can be incorporated in or on the filter overwrap 11 such as by being coated thereon. Alternatively, unfunctionalized porous polyaromatic resin can be incorporated in the mouthpiece filter 8, in the plug 16, and/or in the space 18. Moreover, unfunctionalized porous polyaromatic resin can be incorporated in any element of the filter portion of a cigarette. For example, the filter portion may consist only of the mouthpiece filter 8 and an unfunctionalized porous polyaromatic resin can be incorporated in the mouthpiece filter 8 and/or in the tipping paper 14.

Figure 4:
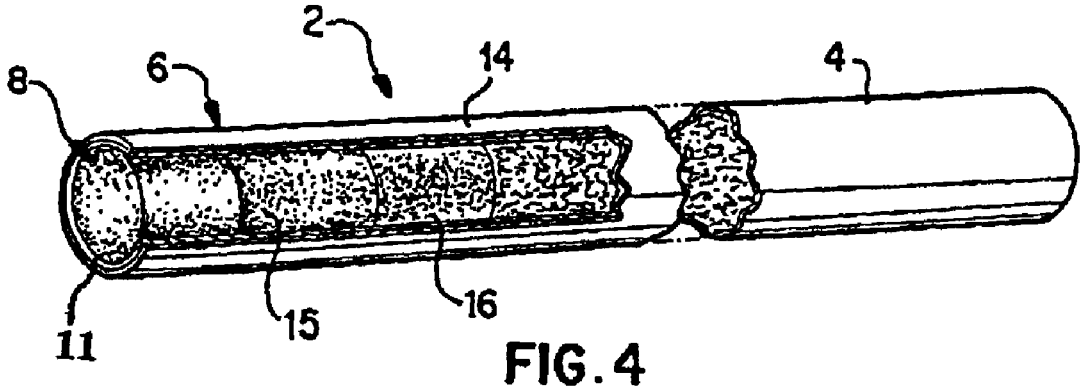
FIG. 4 is a partially exploded perspective view of another embodiment of the present invention wherein an unfunctionalized porous polyaromatic resin is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules (e.g. beads) of an unfunctionalized porous polyaromatic resin or a plug 15 made of material such as fibrous polypropylene or cellulose acetate containing an unfunctionalized porous polyaromatic resin. As in the previous embodiment, the plug 16 can be hollow or solid and the tobacco rod 4 and filter portion 6 are joined together with tipping paper 14. There is also a filter overwrap 11.

Figure 5:
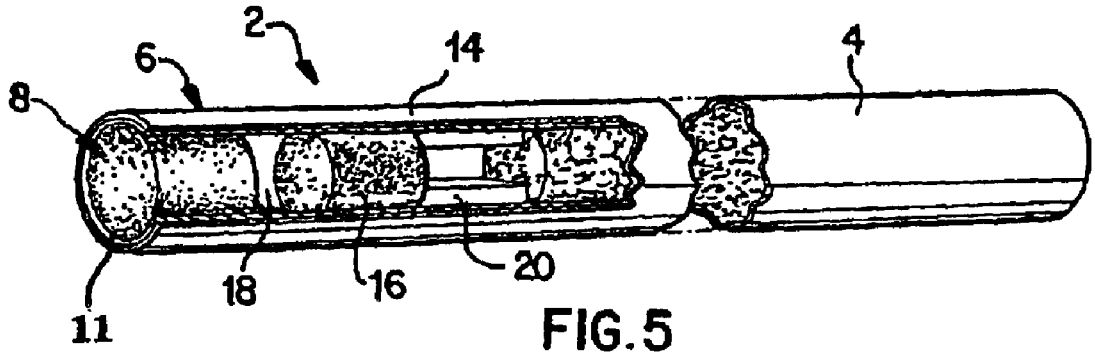
FIG. 5 is a partially exploded perspective view of another embodiment of the present invention wherein an unfunctionalized porous polyaromatic resin is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. An unfunctionalized porous polyaromatic resin can be incorporated into one or more elements of the filter portion 6. For instance, an unfunctionalized porous polyaromatic resin can be incorporated into the sleeve 20 or granules of an unfunctionalized porous polyaromatic resin can be filled into the space within the sleeve 20. If desired, the plug 16 and sleeve 20 can be made of material such as fibrous polypropylene or cellulose acetate containing the unfunctionalized porous polyaromatic resin. As in the previous embodiment, the plug 16 can be hollow or solid.

Figure 6:
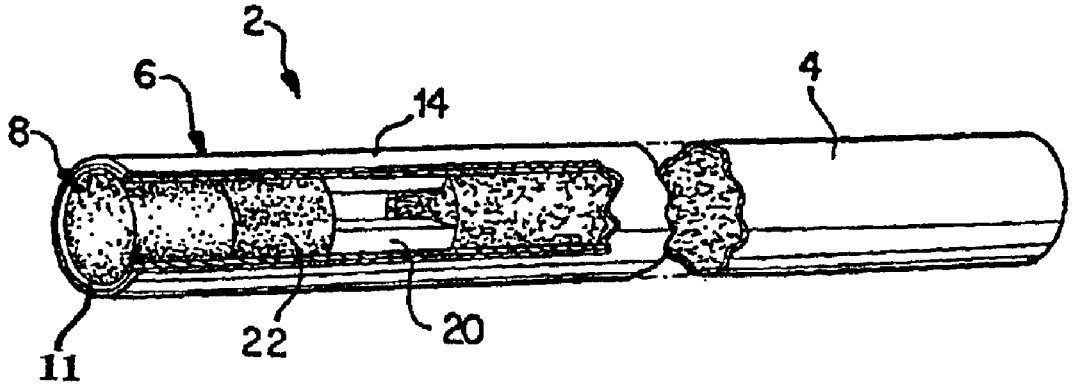
FIG. 6 is a partially exploded perspective view of another embodiment of the present invention wherein an unfunctionalized porous polyaromatic resin is incorporated in a three-part filter element having two plugs and a hollow sleeve.
Figure 7:
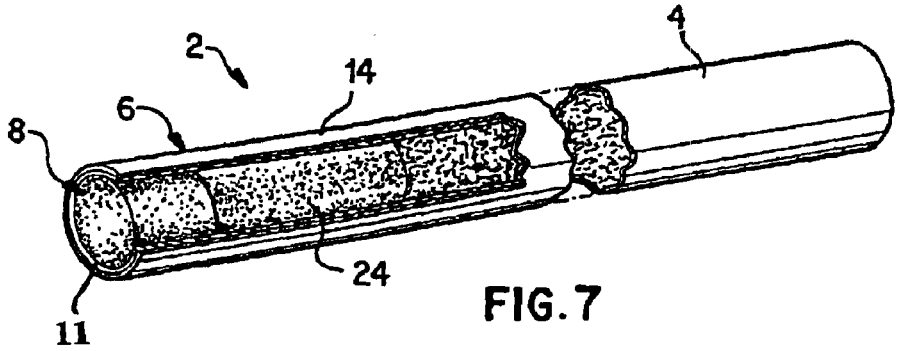
FIG. 7 is a partially exploded perspective view of another embodiment of the present invention wherein an unfunctionalized porous polyaromatic resin is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and an unfunctionalized porous polyaromatic resin can be incorporated in one or more of these filter elements. In FIG. 7, the filter portion 6 includes a mouthpiece filter 8 and a plug 24, and an unfunctionalized porous polyaromatic resin can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply an unfunctionalized porous polyaromatic resin to filter fibers or other substrate supports. For example, an unfunctionalized porous polyaromatic resin can be added to the filter fibers before they are formed into a filter cartridge, e.g., a tip for a cigarette. An unfunctionalized porous polyaromatic resin can be added to the filter fibers, for example, in the form of a dry powder or a slurry. If an unfunctionalized porous polyaromatic resin is applied in the form of a slurry, the fibers are allowed to dry before they are formed into a filter cartridge.

In another preferred embodiment, an unfunctionalized porous polyaromatic resin is employed in a hollow portion of a cigarette filter. For example, some cigarette filters have a plug/space/plug configuration in which the plugs comprise a fibrous filter material and the space is simply a void between the two filter plugs, which can be filled with the unfunctionalized porous polyaromatic resin. An example of this embodiment is shown in FIG. 3. The unfunctionalized porous polyaromatic resin can be in granular form or can be loaded onto a suitable support such as a fiber or thread.

Figure 8:
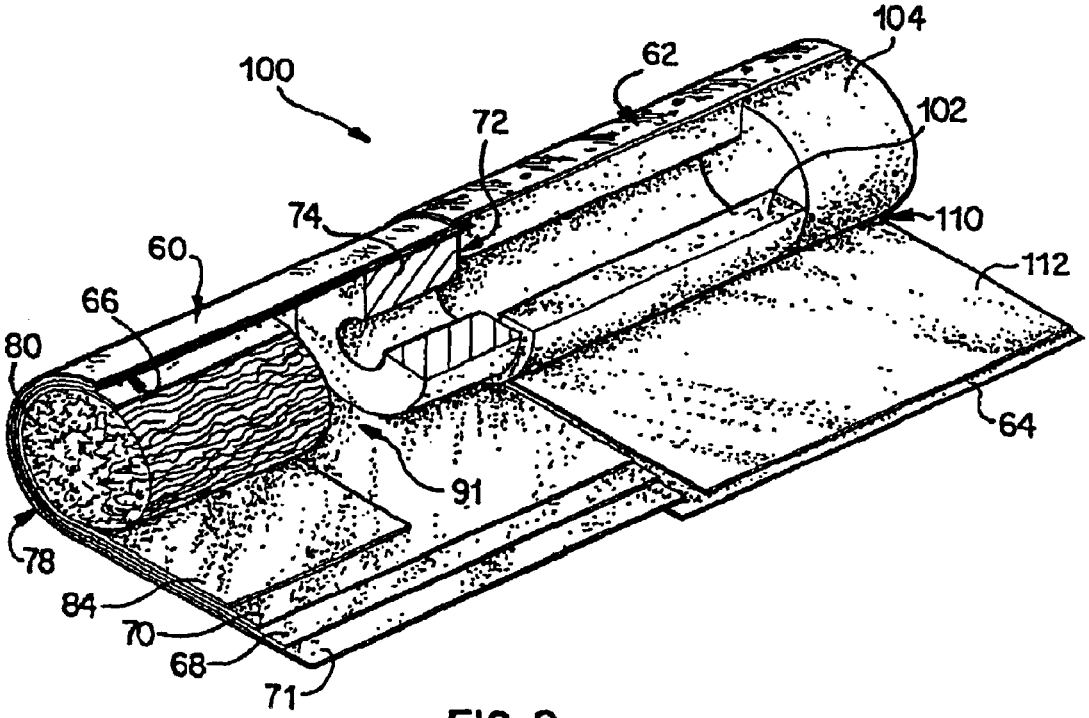
FIG. 8 is a partially exploded perspective view of another embodiment of the present invention wherein an unfunctionalized porous polyaromatic resin is incorporated in a filter element which may be used in a smoking article.

In another embodiment, the unfunctionalized porous polyaromatic resin is employed in a filter portion of a cigarette for use with a smoking device as described in U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating the unfunctionalized porous polyaromatic resin.

In such a cigarette, an unfunctionalized porous polyaromatic resin can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, an unfunctionalized porous polyaromatic resin can be incorporated into the fibrous wall portions of the tubular free-flow filter element 102 itself. For instance, the tubular free-flow filter element or sleeve 102 can be made of suitable materials such as polypropylene or cellulose acetate fibers and an unfunctionalized porous polyaromatic resin can be mixed with such fibers prior to or as part of the sleeve forming process.

In another embodiment, an unfunctionalized porous polyaromatic resin can be incorporated into the mouthpiece filter plug 104 instead of in the element 102. However, as in the previously described embodiments, an unfunctionalized porous polyaromatic resin may be incorporated into more than one constituent of a filter portion such as by being incorporated into the mouthpiece filter plug 104 and into the tubular free-flow filter element 102.

The filter portion 62 of FIG. 8 can also be modified to create a void space into which an unfunctionalized porous polyaromatic resin can be inserted.

As explained above, an unfunctionalized porous polyaromatic resin can be incorporated in various support materials. When particles of an unfunctionalized porous polyaromatic resin are used in filter paper, the particles may have an average particle diameter below 100 $\mu$m, preferably below 50 $\mu$m, and most preferably 1 to 25 $\mu$m. When an unfunctionalized porous polyaromatic resin is used in granular form, larger particles may be used. Such particles preferably have a mesh size from 25 to 60, and more preferably from 35 to 60 mesh.

The amount of an unfunctionalized porous polyaromatic resin employed in the cigarette filter by way of incorporation on a suitable support such as filter paper and/or filter fibers depends on the amount of constituents in the tobacco smoke and the amount of selected constituents to be removed. As an example, the filter paper and the filter fibers may contain from 10% to 50% by weight of the unfunctionalized porous polyaromatic resin. In the case of a cigarette, the filter may contain from about 10 mg to about 300 mg, and more preferable from about 20 mg to about 100 mg of the unfunctionalized porous polyaromatic resin.

In an embodiment, the invention also relates to cigarettes comprising the cigarette filter.

The invention also relates to methods for making cigarette filters, comprising incorporating an unfunctionalized porous polyaromatic resin into a cigarette filter, wherein the unfunctionalized porous polyaromatic resin is capable of removing at least some of at least one constituent in mainstream tobacco smoke through sorption. Any conventional or modified method of making cigarette filters may be used to incorporate the unfunctionalized porous polyaromatic resin.

In yet another embodiment, the invention also relates to methods for making cigarettes, comprising: (i) providing a cut filler to a cigarette making machine to form a tobacco rod; (ii) placing a paper wrapper around the tobacco rod; and (iii) attaching a cigarette filter comprising an unfunctionalized porous polyaromatic resin to the tobacco rod using tipping paper to form the cigarette.

Examples of suitable types of tobacco materials which may be used include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The tobacco may include tobacco substitutes.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.).

Cigarettes incorporating the unfunctionalized porous polyaromatic resin can be manufactured to any desired specification using standard or modified cigarette making techniques and equipment. The cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density of the tobacco is typically between the range of about 100 mg/cm$^3$ to about 300 mg/cm$^3$, and preferably 150 mg/cm$^3$ to about 275 mg/cm$^3$.

The invention also relates to methods of smoking cigarettes comprising unfunctionalized porous polyaromatic resins, which comprise lighting the cigarette to form smoke and drawing the smoke through the cigarette, wherein during the smoking of the cigarette, the unfunctionalized porous polyaromatic resin removes at least some of at least one constituent in mainstream tobacco smoke.

The following Examples serve to further illustrate various aspects the invention. The Examples are not meant to and should not be construed to limit the invention in any way. Furthermore, while the invention has been described in detail with reference to preferred embodiments thereof, it will be apparent to one skilled in the art that various changes can be made, and equivalents employed, without departing from the scope of the invention.

EXAMPLES

Various unfunctionalized porous polyaromatic resins were tested for their ability to remove gas phase constituents from mainstream smoke. All cigarettes tested in this study were either standard 1R4F Kentucky reference cigarettes or test cigarettes consisting of 1R4F cigarettes with modified plug/space/plug filters. These were fabricated in the following manner: First the cellulose acetate (CA) filter was removed from a 1R4F cigarette leaving the filter overwrap intact. The CA filter was shortened by 8–10 mm and reinserted into the filter overwrap to become the first "plug" in the PSP filter. Test adsorbent materials were then added, and a second plug of CA was inserted completing the PSP filter. The excess portion of the CA plug was further removed by a razor blade. A schematic diagram of the formed PSP type cigarette testing sample is shown in FIG. 1. Note that the included adsorbent materials are placed behind the dilution holes to minimize the change on ventilation.

Figure 9:
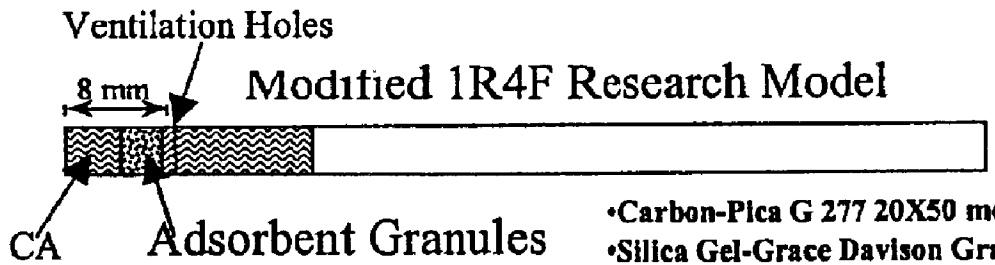
FIG. 9 is a schematic diagram of the formed PSP (plug/space/plug) type cigarette for testing a sample. Shown are results for carbon, silica gel, XAD-16, and an 1R4F Average/Sigma control.

As indicated in FIG. 9, the adsorbent materials tested were from commercial sources. Some of their physical properties are listed in FIG. 9. Also shown are the resistances to draw (RTD) and % dilution of the prepared test cigarettes. These values compared favorably with the reference 1R4F cigarettes. In general, about 100 mg of 20–60 mesh adsorbent materials were put into the PSP space except in the case of using smaller 35×60 mesh silica gel granules, where only 77 mg could be included to avoid high RTD.

The samples were analyzed using the Multiplex GC/MS method using FTC parameters and procedures described in Thomas, C. E. and Koller, K. B. "*Puff-by-Puff Mainstream Smoke Analyses by Multiplex Gas Chromatography/Mass Spectrometry*," 2000 CORRESTA Conference, Lisbon, Portugal, September, 2000. In the procedure, multiple puffs of cigarette smoke were sequentially injected into a GC/MS system prior to the complete elution of the first injected puff. Relying on the chromatographic separation of the GC column and the spectroscopic separation of the MS detection system, the complex chromatographic data were reduced to meaningful puff-by-puff delivery results for each selected cigarette smoke constituent. The puff-by-puff delivery values, as shown in FIGS. 10 and 11, were reported as percent versus control for average total delivery of a 1R4F cigarette.

Puff-by-Puff Delivery Profiles

The average puff-by-puff delivery values for the gas phase constituents in 1R4F cigarettes can be used as a control for some typical delivery characteristics for each individual compound in the absence of adsorbent materials. Although the delivery behaviors of the constituents can be affected by many parameters including combustion chemistry, sampling methods, tobacco column packing, ventilation, and interaction with cellulose acetate plugs, four typical delivery behaviors were seen in the measured 26 compounds as shown in FIG. 10, which have have designated as Type I–IV profiles.

Figure 10A:
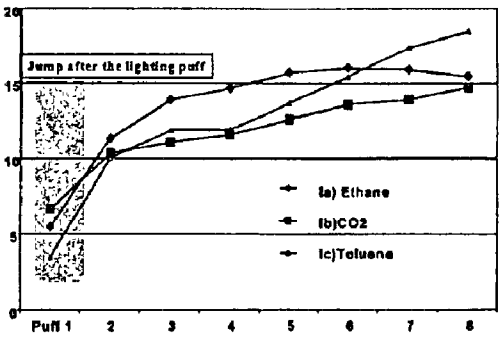
FIGS. 10*a*–10*d* depict Type I–IV delivery profiles of gas phase constituents in mainstream smoke of 1R4F cigarettes. An average of 8 replicas are shown in each case.

In a Type I profile, the constituents are delivered in lower concentrations during the initial lighting puff, but then increase in the second and succeeding puffs as shown in FIG. 10*a*. The compounds in this category are diacetyl, toluene, hydrogen cyanide, carbonyl sulfide, hydrogen sulfide, 2,5-dimethyl furan, methyl furan, methyl ethyl ketone, and cyclopentanone.

Figure 10B:
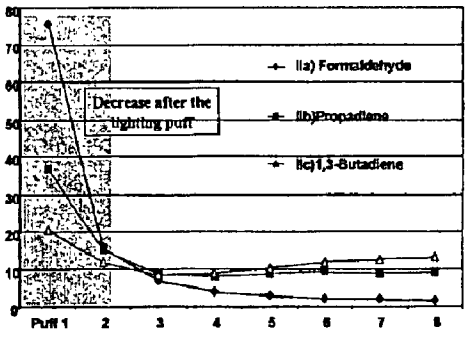
Figure 10C:
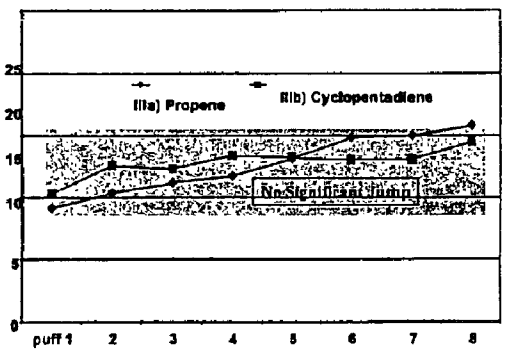
Figure 10D:
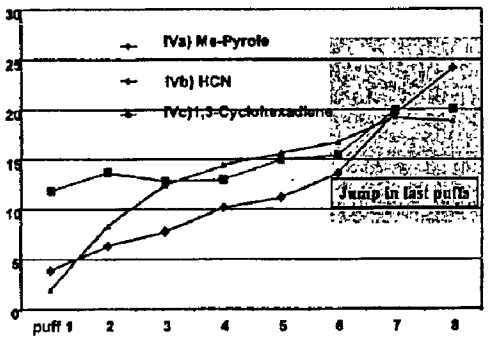

The Type II profile is the opposite of Type I. These constituents are delivered at higher concentrations during the initial lighting puffs, and significantly decrease in the second and succeeding puffs as shown in FIG. 10*b*. Compounds in this category are formaldehyde, propadiene, and 1,3-butadiene, for example.

Compounds with Type III profiles tend not to show any abrupt change in deliveries during the whole smoking duration. Some gradual increase in deliveries may be observed from first puff to the eighth puff, due to changes in ventilation ratios and diffusion through the cigarette paper. The compounds in this category include propene, cyclopentadiene, methyl cyclopentadiene, acetaldehyde, acrolein, and benzene.

Compounds with Type IV delivery profiles rapidly increased in concentration during the last few puffs. Generally, there was a significant jump up in deliveries in the last 2–3 puffs. The compounds in this category are methyl pyrrole, acetone, methyl mercaptan, acrylonitrile, isoprene, and 1,3-cyclohexadiene.

In PSP filters containing activated carbon, silica gel or polyaromatic resins, there are different levels of reduction for gas phase compounds depending on the adsorbent used. FIG. 11 shows the puff-by-puff filtration of selected gas phase compounds by the PSP filters with adsorbents. The PSP filter with activated carbon was most efficient at removing all the gas phase compounds. Its filtration performance is superior to both silica gel and XAD-16 resin. The filtration performance of silica gel and XAD-16 polyaromatic resin varied with the chemical nature of the individual constituents as discussed in following sections.

Figure 11A:
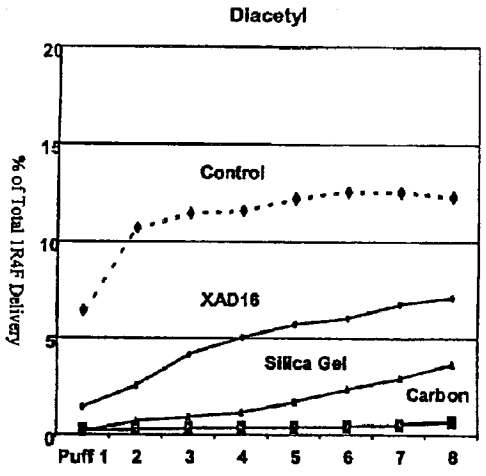
FIGS. 11*a*–11*h* depict the effects of PSP adsorbent filters on the puff-by-puff delivery profiles of representative gas phase constituents, such as diacetyl (FIG. 11*a*), toluene (FIG. 11*b*), formaldehyde (FIG. 11*c*), 1,3-butadiene (FIG. 11*d*), acetaldehyde (FIG. 11*e*), acrolein (FIG. 11*f*), 1-methyl pyrrole (FIG. 11*g*), and isoprene (FIG. 11*h*).
Figure 11B:
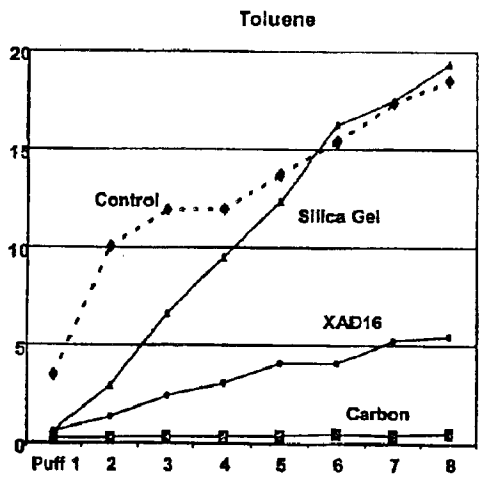

As shown in FIGS. 11*a* and 11*b*, both diacetyl and toluene exhibit Type I delivery profiles in the control 1R4F cigarettes. Toluene also exhibits some Type IV delivery profile characteristics. In comparison, XAD-16 resin was more efficient at removing toluene than silica gel, but silica gel was more efficient at removing the more polar diacetyl. For toluene, the silica gel removed about 75% in the first two puffs, but quickly lost this activity by the fourth puff. XAD-16 resin had about the same initial removal efficiency for toluene as the silica gel, but maintained its efficiency throughout the succeeding puffs.

Figure 11C:
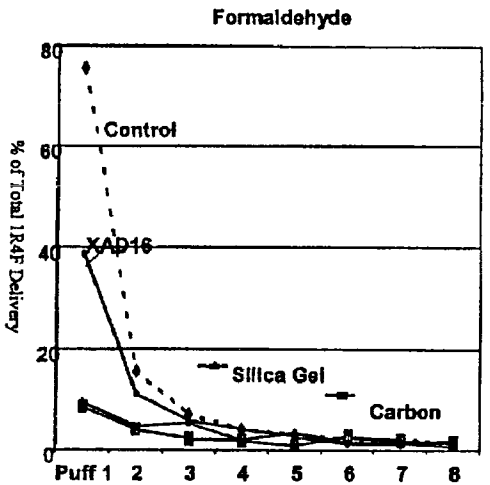
Figure 11D:
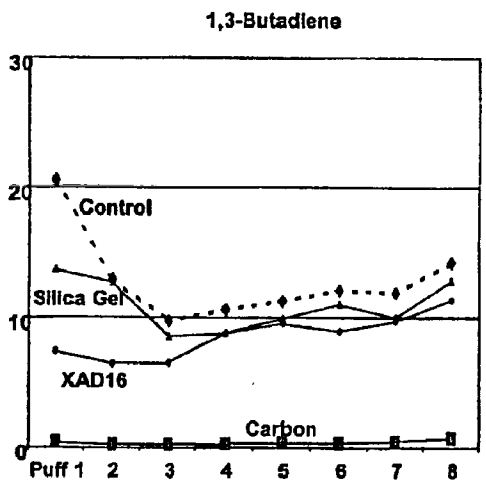

FIGS. 11*c* and 11*d* show that the puff-by-puff delivery of formaldehyde and 1,3-butadiene of 1R4F cigarettes exhibited Type II profiles. In comparing PSP filters containing silica gel and XAD-16 resin, the silica gel was more efficient at removing the polar formaldehyde, while XAD-16 resin was better at removing 1,3-butadiene.

Figure 11E:
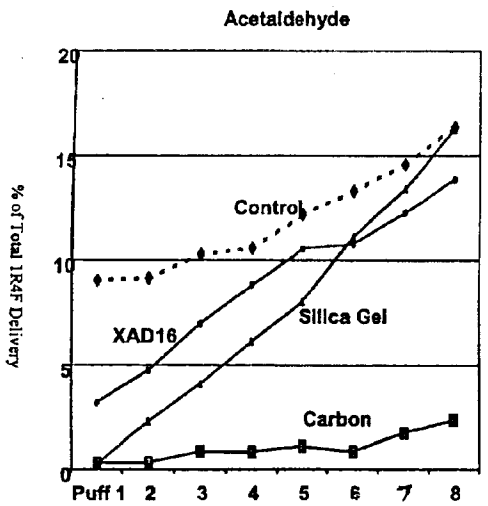
Figure 11F:
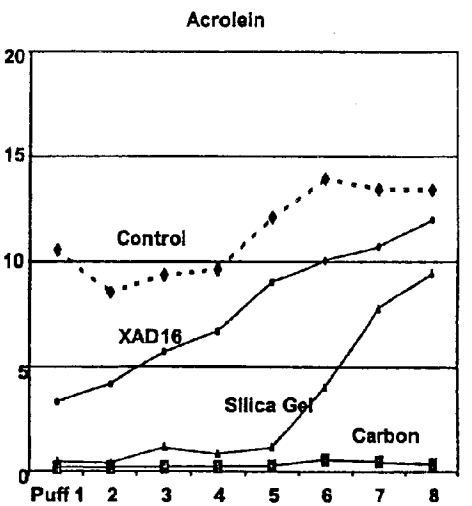

In FIGS. 11*e* and 11*f*, both acetaldehyde and acrolein exhibited Type III delivery profiles in the control 1R4F cigarettes. Similar results were obtained for acetaldehyde and acrolein removal rates by PSP silica gel and XAD-16 filters. In both cases, silica gel is more effective in removing compounds with polar aldehyde groups. A greater difference is shown in the case of acrolein, where silica gel at its 70-mg loading in the PSP filter maintained about 90% removal until the fifth puff, while XAD-16 resin at its 100-mg loading level had only about 20% removal activity left at this puff.

Figure 11G:
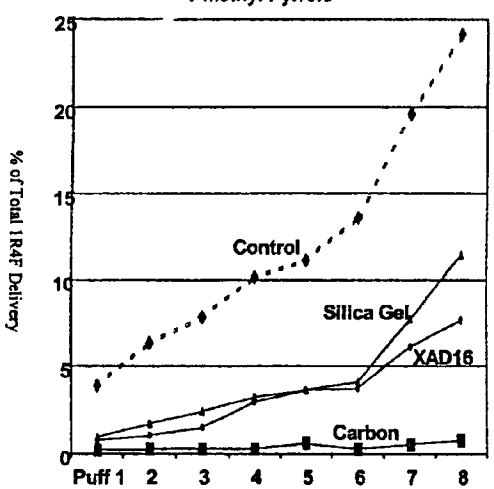
Figure 11H:
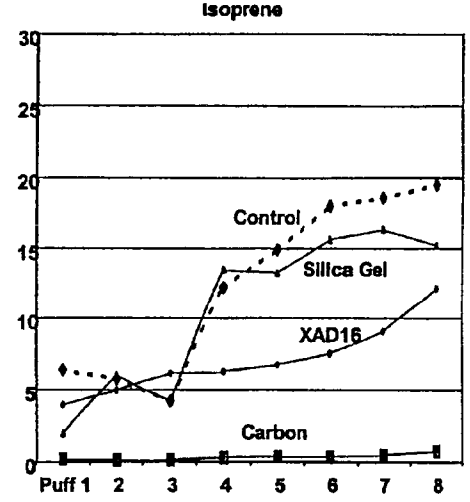

In FIGS. 11*g* and 11*h*, 1-methyl pyrrole and isoprene exhibited Type IV delivery profiles in the control 1R4F cigarettes. PSP filters with both XAD-16 resin and silica gel had comparable removals for 1-methyl pyrrole. However, only XAD-16 had an effect on isoprene delivery. While not wishing to be bound by theory, it is possible that XAD polyaromatic resin may interact with the aromatic ring of polar aromatic molecules such as 1-methyl pyrrole via π—π interactions, while silica gel may interact with its N atom by hydrogen bonding. The activity of XAD resin for isoprene may also come from π—π interactions.

In addition to comparisons of puff-by-puff delivery data, the filtration performances of adsorbents were also compared using the total gas phase constituents deliveries per cigarette. By comparison with 1R4F total deliveries, the total percent reduction for each gas phase compound measured due to the filtration by each particular absorbent can be determined. The percent reduction data are summarized in Tables 1–3. Each of the percent reduction values was statistically evaluated, and if a significant percent reduction of a particular gas phase compound was noted, that amount of reduction is shown in Tables 1–3. If the percent reduction was deemed insignificant (smaller than 30% and 3RSD), it is shown as a blank. The gas phase constituents of the samples were also analyzed using a home made smoking system with FTIR detection system. The results, reported in Table 3, are reduction percentages in gas phase delivery of each constituent per TPM.

Activated carbon significantly reduced all of the gas phase constituents observed except $CO_2$ and ethane. These results are expected since the activated carbon has high surface area (1590 $m^2/g$) and diversified surface activity. In comparison, the silica gel, although it has much lower surface area (275–375 $m^2/g$), still shows significant reduction for polar compounds such as aldehydes, acrolein, ketones and pyrroles. All of the gas phase compounds reduced by silica gel have, in common, hydrogen-bondable O or N atoms. While not wishing to be bound by theory, the filtration performance for these compounds might be the result of hydrogen bonding between Si—OH and O or N atoms with lone electron pairs. Looking at the XAD-16 resin, it has a higher surface area (800 $m^2/g$) than the silica gel, and exhibits adsorbent activity for not only aromatic compounds such as benzene, toluene and furans, but also for cyclic dienes such as 1,3-cyclopentadiene and methyl pentadiene, and ketones such as acetone, methyl ethyl ketone and cyclopentanone. Again, the filtration performance to these classes of compounds may be the result of π—π molecular orbital (MO) interaction between the aromatic systems in the polyaromatic resins and the double bond systems in the adsorbates.

As shown in Tables 1–3, polymeric resins such as Amberlite (XAD-4, XAD-16 hp), DIAION (SP-825L, SP-850), and DOWEX (I-493, V-493, V-502) show varied activity in reducing smoke gas phase constituents. Based on the data, certain high surface area resins, when used as cigarette filter additives, can be effective at removing a wide range of gas phase constituents such as dienes, aldehydes, acrolein, and aromatic compounds. The effects of several factors on the selectivity or activity of polymeric resins among various classes of smoke constituents are discussed in following paragraphs.

The results show that the activity of the resins depends greatly on their specific surface area. As shown in Table 1d–f, XAD-2 resins did not show any significant activity for almost all the gas phase compounds detected, because of its low surface area (<375 $m^2/g$). XAD-4 and XAD-16hp showed significantly increased activity for dienes, furans, pyrroles, aromatics, and ketones with increased specific surface area (725–800 $m^2/g$). With even greater specific surface area (over 1000 $m^2/g$), DIAION (SP-825L, SP-850), and DOWEX (L-493, V-493, V-502) resins showed much greater activities for removing the above mentioned compounds. The selectivity of these for reducing dienes, furans, pyrroles, aromatics, and ketones are comparable with that of the filters using the same amount of Pica G-277 carbon although with much lower specific surface area than G-277 carbon.

The polyaromatic resins used in these experiments were the polymerization products of non-polar styrene and divinyl benzene. Their surfaces are generally believed to be more hydrophobic than that of activated carbon. Filters using some of the polyaromatic resins also show high selectivity for removing polar gas constituents such as formaldehyde, acetaldehyde, acrolein, methanol, hydrogen sulfide, carbonyl sulfides and methyl mercaptan in addition to dienes, furans, pyrroles, aromatics, and ketones. In contrast to activated carbon, the selectivity among different gas phase constituents of mainstream smoke can be varied by using different brands of unfunctionalized porous polyaromatic resins. As shown in Table 2 and Table 3, DOWEX (L-493, V-493, V-502) resin filters show high selective reduction (50–90%) for formaldehyde, acetaldehyde, acrolein and methanol, while DIAION (SP-825L, SP-850) resin filters show very high selective reduction (70–90%) for hydrogen sulfide, carbonyl sulfide and methyl mercaptan.

TABLE 1A

| Adsorbent | 1R4F Control | |
|---|---|---|
| Runs | Average | Sigma |
| RTD/mm$H_2O$ | 140 | 4% |
| DDI % | 30 | 7% |
| Adsorbent/mg | | |
| Surface Area, $m^2/g$ | | |
| Cellulose Acetate Replaced/mg | | |
| | Control | |
| Carbon Dioxide | 97 | 6% |
| Propene | 100 | 8% |
| Hydrogen Cyanide | 100 | 17% |
| Ethane | 100 | 8% |
| Propadiene | 100 | 13% |
| 1,3-Butadiene | 103 | 10% |
| Isoprene | 93 | 9% |
| Cyclopentadiene | 97 | 9% |
| 1,3-Cyclohexadiene | 104 | 10% |
| Methyl Cyclopentadiene | 103 | 9% |
| Formaldehyde | 102 | 24% |
| Acetaldehyde | 98 | 8% |
| Acrolein | 97 | 14% |
| Acetone | 100 | 9% |
| Diacetyl | 100 | 12% |
| Methyl ethyl ketone | 97 | 9% |
| Cyclopentanone | 99 | 9% |
| Benzene | 96 | 9% |
| Toluene | 92 | 9% |
| Acrylonitrile | 81 | 21% |
| Methyl Furan | 107 | 7% |
| 2,5-dimethyl Furan | 107 | 8% |
| Hydrogen Sulfide | 98 | 18% |
| Carbonyl Sulfide | 94 | 10% |
| Methyl Mecaptan | 107 | 11% |
| 1-methyl Pyrrole | 103 | 10% |

*Reduction measured from Puff by Puff Multoplex GC/MS method: shown as blanks when the absolute reduction values are less than 30% and 3 sigma.

TABLE 1B

| Adsorbent | Carbon | |
|---|---|---|
| Runs | C1 | C2 |
| RTD/mm$H_2O$ | 155 | 145 |
| DDI % | 22 | 28 |
| Adsorbent/mg | 102 | 107 |
| Surface Area, $m^{2/g}$ | ~1800 | |
| Cellulose Acetate Replaced/mg | −25 | −29 |
| | Reduction | |
| Carbon Dioxide | | |
| Propene | −78% | −65% |
| Hydrogen Cyanide | −91% | −68% |
| Ethane | | |
| Propadiene | −71% | −66% |
| 1,3-Butadiene | −97% | −97% |
| Isoprene | −97% | −82% |
| Cyclopentadien | −97% | −82% |
| 1,3-Cyclohexadiene | −98% | −83% |
| Methyl Cyclopentadiene | −97% | −84% |
| Formaldehyde | −78% | −72% |
| Acetaldehyde | −91% | −72% |
| Acrolein | −97% | −90% |
| Acetone | −97% | −83% |
| Diacetyl | −97% | −81% |
| Methyl ethyl ketone | −98% | −84% |
| Cyclopentanone | −94% | −76% |
| Beuzene | −98% | −85% |
| Toulene | −97% | −82% |
| Acrylonitrile | −93% | −71% |
| Methyl Furan | −97% | −85% |
| 2,5-dimethyl Furan | −97% | −84% |
| Hydrogen Sulfide | −98% | −70% |
| Carbonyl Sulfide | −85% | −48% |
| Methyl Mecaptan | −78% | −63% |
| 1−methyl Pyrrole | −97% | −82% |

*Reduction measured from Puff by Puff Multiplex GC/MS method: shown as blanks when the absolute reduction values are less than 30% and 3 sigma.

TABLE 1C

| Adsorbent | Silica Gel | |
|---|---|---|
| Runs | S1 | S2 |
| RTD/mm$H_2O$ | 167 | 177 |
| DDI % | 25 | 23 |
| Adsorbent/mg | 77 | 76 |
| Surface Area, $m^2/g$ | 275–375 | |
| Cellulose Acetate Replaced/mg | −32 | −23 |
| | Reduction | |
| Carbon Dioxide | | |
| Propene | | |
| Hydrogen Cyanide | | |
| Ethane | | |
| Propadiene | | |
| 1,3-Butadiene | | |
| Isoprene | | |
| Cyclopentadien | | |
| 1,3-Cyclohexadiene | | |
| Methyl Cyclopentadiene | | |
| Formaldehyde | −58% | −74% |
| Acetaldehyde | −32% | −36% |
| Acrolein | −55% | −73% |
| Acetone | −72% | −89% |
| Diacetyl | −62% | −84% |
| Methyl ethyl ketone | −75% | −91% |
| Cyclopentanone | −57% | −62% |
| Benzene | | |
| Toulene | | |

TABLE 1C-continued

| | | |
|---|---|---|
| Acrylonitrile | −35% | −40% |
| Methyl Furan | | |
| 2,5-dimethyl Furan | | |
| Hydrogen Sulfide | | |
| Carbonyl Sulfide | | |
| Methyl Mecaptan | | |
| 1-methyl Pyrrole | −38% | −64% |

*Reduction measured from Puff by Puff Multiplex GC/MS method: shown as blanks when the absolute reduction values are less than 30% and 3 sigma.

TABLE 1D

| Adsorbent | XAD-2 | |
|---|---|---|
| Runs | x2-1 | x2-2 |
| RTD/mm$H_2O$ | 139 | 140 |
| DDI % | 24 | 26 |
| Adsorbent/mg | 104 | 104 |
| Surface Area, $m^2/g$ | 300 | |
| Cellulose Acetate Replaced/mg | −18 | −18 |
| Carbon Dioxide | | |
| Propene | | |
| Hydrogen Cyanide | | |
| Ethane | | |
| Propadiene | | |
| 1,3-Butadiene | | |
| Isoprene | | |
| Cyclopentadien | | |
| 1,3-Cyclohexadiene | | |
| Methyl Cyclopentadiene | | |
| Formaldehyde | | |
| Acetaldehyde | | |
| Acrolein | | |
| Acetone | | |
| Diacetyl | | |
| Methyl ethyl ketone | | |
| Cyclopentanone | | |
| Benzene | | |
| Toulene | | |
| Acrylonitrile | | −46% |
| Methyl Furan | | |
| 2,5-dimethyl Furan | | |
| Hydrogen Sulfide | | |
| Carbonyl Sulfide | | |
| Methyl Mecaptan | | |
| 1-methyl Pyrrole | | |

*Reduction measured from Puff by Puff Multiplex GC/MS method: shown as blanks when the absolute reduction values are less than 30% and 3 sigma.

TABLE 1E

| Adsorbent | XAD-4 | |
|---|---|---|
| Runs | x4-1 | x4-2 |
| RTD/mm$H_2O$ | 134 | 123 |
| DDI % | 24 | 26 |
| Adsorbent/mg | 102 | 103 |
| Surface Area, $m^2/g$ | 725 | |
| Cellulose Acetate Replaced/mg | −40 | −44 |
| Carbon Dioxide | | |
| Propene | | |
| Hydrogen Cyanide | | |
| Ethane | | |
| Propadiene | | |
| 1,3-Butadiene | | |
| Isoprene | −34% | −25% |
| Cyclopentadien | −32% | −24% |
| 1,3-Cyclohexadiene | −52% | −45% |

TABLE 1E-continued

| | | |
|---|---|---|
| Methyl Cyclopentadiene | −47% | −36% |
| Formaldehyde | | |
| Acetaldehyde | | |
| Acrolein | −30% | |
| Acetone | −35% | −28% |
| Diacetyl | −45% | −41% |
| Methyl ethyl ketone | −45% | −39% |
| Cyclopentanone | −49% | −47% |
| Benzene | −48% | −44% |
| Toulene | −59% | −53% |
| Acrylonitrile | −44% | |
| Methyl Furan | −42% | −36% |
| 2,5-dimethyl Furan | −53% | −46% |
| Hydrogen Sulfide | | |
| Carbonyl Sulfide | | |
| Methyl Mecaptan | | |
| 1-methyl Pyrrole | −62% | −50% |

*Reduction measured from Puff by Puff Multiplex GC/MS method: shown as blanks when the absolute reduction values are less than 30% and 3 sigma.

TABLE 1F

| Adsorbent | XAD-16 hp | |
|---|---|---|
| Runs | x4-1 | x4-2 |
| RTD/mm$H_2O$ | 130 | 133 |
| DDI % | 24 | 23 |
| Adsorbent/mg | 102 | 104 |
| Surface Area, $m^2/g$ | 800 | |
| Cellulose Acetate Replaced/mg | −15 | −21 |
| Carbon Dioxide | | |
| Propene | | |
| Hydrogen Cyanide | | |
| Ethane | | |
| Propadiene | −41% | |
| 1,3-Butadiene | −33% | |
| Isoprene | −39% | −29% |
| Cyclopentadien | −39% | −24% |
| 1,3-Cyclohexadiene | −64% | −52% |
| Methyl Cyclopentadiene | −60% | −48% |
| Formaldehyde | −34% | −42% |
| Acetaldehyde | −27% | |
| Acrolein | −36% | −29% |
| Acetone | −40% | −27% |
| Diacetyl | −61% | −54% |
| Methyl ethyl ketone | −43% | −45% |
| Cyclopentanone | −75% | −60% |
| Benzene | −61% | −49% |
| Toulene | −72% | −62% |
| Acrylonitrile | −54% | −40% |
| Methyl Furan | −53% | −48% |
| 2,5-dimethyl Furan | −67% | −65% |
| Hydrogen Sulfide | | |
| Carbonyl Sulfide | | |
| Methyl Mecaptan | | |
| 1-methyl Pyrrole | −74% | −61% |

*Reduction measured from Puff by Puff Multiplex GC/MS method: shown as blanks when the absolute reduction values are less than 30% and 3 sigma.

TABLE 2A

| Adsorbent | 1R4F Control | |
|---|---|---|
| Runs | Average | Sigma |
| RTD/mm $H_2O$ | 134 | 1% |
| DDI % | 25.5 | 8% |
| Adsorbent/mg | | |
| Surface Area, $m^2/g$ | | |
| Cellulose Acetate Replaced/mg | | |

TABLE 2A-continued

| Gas phase components | Control | |
|---|---|---|
| Carbon Dioxide | 98 | 4% |
| Propene | 95 | 6% |
| Hydrogen Cyanide | 93 | 10% |
| Ethane | 98 | 7% |
| Propadiene | 96 | 14% |
| 1,3-Butadiene | 97 | 9% |
| Isoprene | 108 | 5% |
| Cyclopentadiene | 101 | 4% |
| 1,3-Cyclohexadiene | 107 | 9% |
| Methyl Cyclopentadiene | 103 | 11% |
| Formaldehyde | 104 | 13% |
| Acetaldehyde | 97 | 9% |
| Acrolein | 83 | 17% |
| Acetone | 106 | 10% |
| Diacetyl | 102 | 6% |
| Methyl ehlhyl ketone | 100 | 11% |
| isovaleraldehyde | 71 | 24% |
| Benzene | 101 | 8% |
| Toluene | 102 | 6% |
| 1-Butyl nitrite | 102 | 8% |
| Methyl Furan | 101 | 6% |
| 2,5-dimethyl Furan | 105 | 6% |
| Hydrogen Sulfide | 100 | 5% |
| Carbonyl Sulfide | 99 | 6% |
| Methyl Mecaptan | 101 | 5% |
| 1-Methyl Pyrrole | 98 | 8% |
| Ketene | 106 | 12% |
| Acetylene | 94 | 12% |

*Reduction measured from Puff by Puff Multoplex GC/MS method; Shown as blanks when the absolute reduction values are less than 30% and 3 sigma.

TABLE 2B

| Adsorbent | XAD-16 hp | |
|---|---|---|
| Runs | x16-3 | x16-4 |
| RTD/mm $H_2O$ | 125 | 120 |
| DDI % | 24 | 30 |
| Adsorbent/mg | 100 | 101 |
| Surface Area, $m^2/g$ | 800 | |
| Cellulose Acetate Replaced/mg | −21 | −14 |
| Gas phase components | Reduction | |
| Carbon Dioxide | | |
| Propene | | |
| Hydrogen Cyanide | | |
| Ethane | | |
| Propadiene | | |
| 1,3-Butadiene | | |
| Isoprene | −16% | −19% |
| Cyclopentadiene | −22% | −29% |
| 1, 3 Cyclohexadiene | −54% | −54% |
| Methyl Cyclopentadiene | −57% | −59% |
| Formaldehyde | −44% | −33% |
| Acetaldehyde | | |
| Acrolein | | |
| Acetone | | |
| Diacetyl | −54% | −55% |
| Methyl ethyl ketone | −47% | −50% |
| isovaleraldehyde | −41% | −45% |
| Benzene | −52% | −56% |
| Toluene | −72% | −69% |
| 1-Butyl nitrite | −47% | −40% |
| Methyl Furan | −47% | −47% |
| 2,5-dimethyl Furan | −69% | −63% |
| Hydrogen Sulfide | | |
| Carbonyl Sulfide | | |
| Methyl Mecaptan | | |

TABLE 2B-continued

| | | |
|---|---|---|
| 1-Methyl Pyrrole | −61% | −51% |
| Ketene | −50% | |
| Acetylene | | |

*Reduction measured from Puff by Puff Multoplex GC/MS method; Shown as blanks when the absolute reduction values are less than 30% and 3 sigma.

TABLE 2C

| Adsorbent | SP825L | |
|---|---|---|
| Runs | SP-3 | SP-4 |
| RTD/mm $H_2O$ | 133 | 133 |
| DDI % | 23 | 25 |
| Adsorbent/mg | 100 | 101 |
| Surface Area, $m^2/g$ | 1000 | |
| Cellulose Acetate Replaced/mg | −14 | −21 |
| Gas phase components | | |
| Carbon Dioxide | | |
| Propene | | |
| Hydrogen Cyanide | | |
| Ethane | | |
| Propadiene | | |
| 1,3-Butadiene | | |
| Isoprene | −56% | −53% |
| Cyclopentadiene | −50% | −50% |
| 1,3-Cyclohexadiene | −88% | −82% |
| Methyl Cyclopentadiene | −86% | −83% |
| Formaldehyde | | |
| Acetaldehyde | | |
| Acrolein | | |
| Acetone | −40% | −39% |
| Diacetyl | −77% | −76% |
| Methyl ethyl ketone | −79% | −78% |
| isovaleraldehyde | −80% | −79% |
| Benzene | −83% | −81% |
| Toluene | −91% | −89% |
| 1-Butyl nitrite | −76% | −73% |
| Methyl Furan | −86% | −85% |
| 2,5-dimethyl Furan | −84% | −82% |
| Hydrogen Sulfide | −91% | −89% |
| Carbonyl Sulfide | −76% | −72% |
| Methyl Mecaptan | −77% | −72% |
| 1-Methyl Pyrrole | −91% | −87% |
| Ketene | | |
| Acetylene | | |

*Reduction measured from Puff by Puff Multoplex GC/MS method; Shown as blanks when the absolute reduction values are less than 30% and 3 sigma.

TABLE 2D

| Adsorbent | SP850 | |
|---|---|---|
| Runs | SP-1 | SP-2 |
| RTD/mm $H_2O$ | 139 | 139 |
| DDI % | 24 | 23 |
| Adsorbent/mg | 100 | 101 |
| Surface Area, $m^2/g$ | 1000 | |
| Cellulose Acetate Replaced/mg | −21 | −14 |
| Gas phase components | | |
| Carbon Dioxide | | |
| Propene | | |
| Hydrogen Cyanide | | |
| Ethane | | |
| Propadiene | | |
| 1,3-Butadiene | −36% | |
| Isoprene | −66% | −56% |
| Cyclopentadiene | −61% | −53% |
| 1,3-Cyclohexadiene | −90% | −86% |

TABLE 2D-continued

| | | |
|---|---|---|
| Methyl Cyclopentadiene | −89% | −85% |
| Formaldehyde | | |
| Acetaldehyde | | |
| Acrolein | | |
| Acetone | −48% | −44% |
| Diacetyl | −84% | −81% |
| Methyl ethyl ketone | −86% | −83% |
| isovaleraldehyde | −86% | −82% |
| Benzene | −89% | −85% |
| Toluene | −93% | −91% |
| 1-Butyl nitrite | −84% | −82% |
| Methyl Furan | −90% | −87% |
| 2,5-dimethyl Furan | −90% | −86% |
| Hydrogen Sulfide | −93% | −91% |
| Carbonyl Sulfide | −84% | −82% |
| Methyl Mecaptan | −82% | −77% |
| 1-Methyl Pyrrole | −95% | −91% |
| Ketene | | |
| Acetylene | | |

*Reduction measured from Puff by Puff Multoplex GC/MS method; Shown as blanks when the absolute reduction values are less than 30% and 3 sigma.

TABLE 2E

| Adsorbent | V502 | |
|---|---|---|
| Runs | V2-1 | V2-2 |
| RTD/mm $H_2O$ | 115 | 114 |
| DDI % | 25 | 25 |
| Adsorbent/mg | 100 | 101 |
| Surface Area, $m^2/g$ | 1080 | |
| Cellulose Acetate Replaced/mg | 35 | 35 |
| Gas phase components | | |
| Carbon Dioxide | | |
| Propene | −22% | −28% |
| Hydrogen Cyanide | | −33% |
| Ethane | | |
| Propadiene | | |
| 1,3-Butadiene | −54% | −58% |
| Isoprene | −64% | −69% |
| Cyclopentadiene | −64% | −67% |
| 1,3-Cyclohexadiene | −73% | −78% |
| Methyl Cyclopentadiene | −76% | −80% |
| Formaldehyde | −49% | −53% |
| Acetaldehyde | −54% | −58% |
| Acrolein | −75% | −82% |
| Acetone | −75% | −78% |
| Diacetyl | −77% | −81% |
| Methyl ethyl ketone | −81% | −83% |
| isovaleraldehyde | −69% | −69% |
| Benzene | −73% | −77% |
| Toluene | −76% | −80% |
| 1-Butyl nitrite | −75% | −78% |
| Methyl Furan | −72% | −76% |
| 2,5-dimethyl Furan | −75% | −79% |
| Hydrogen Sulfide | | −15% |
| Carbonyl Sulfide | | −22% |
| Methyl Mecaptan | −45% | −44% |
| 1-Methyl Pyrrole | −72% | −79% |
| Ketene | | −46% |
| Acetylene | | |

*Reduction measured from Puff by Puff Multoplex GC/MS method; Shown as blanks when the absolute reduction values are less than 30% and 3 sigma.

TABLE 2F

| Adsorbent | V493 | |
|---|---|---|
| Runs | V3-1 | V3-2 |
| RTD/mm $H_2O$ | 124 | 123 |
| DDI % | 30 | 29 |
| Adsorbent/mg | 101 | 100 |
| Surface Area, $m^2/g$ | 1100 | |
| Cellulose Acetate Replaced/mg | 35 | 35 |
| Gas phase components | | |
| Carbon Dioxide | | |
| Propene | −26% | −31% |
| Hydrogen Cyanide | −53% | −53% |
| Ethane | | |
| Propadiene | −44% | |
| 1,3-Butadiene | −71% | −74% |
| Isoprene | −85% | −90% |
| Cyclopentadiene | −83% | −87% |
| 1,3-Cyclohexadiene | −90% | −93% |
| Methyl Cyclopentadiene | −89% | −93% |
| Formaldehyde | −69% | −74% |
| Acetaldehyde | −74% | −82% |
| Acrolein | −83% | −90% |
| Acetone | −89% | −91% |
| Diacetyl | −90% | −94% |
| Methyl ethyl ketone | −93% | −95% |
| isovaleraldehyde | −87% | −90% |
| Benzene | −90% | −93% |
| Toluene | −93% | −95% |
| 1-Butyl nitrite | −92% | −93% |
| Methyl Furan | −88% | −91% |
| 2,5-dimethyl Furan | −92% | −94% |
| Hydrogen Sulfide | −21% | −21% |
| Carbonyl Sulfide | | −20% |
| Methyl Mecaptan | −60% | −65% |
| 1-Methyl Pyrrole | −91% | −94% |
| Ketene | −69% | −74% |
| Acetylene | −30% | −38% |

*Reduction measured from Puff by Puff Multoplex GC/MS method; Shown as blanks when the absolute reduction values are less than 30% and 3 sigma.

TABLE 2G

| Adsorbent | L-493 | |
|---|---|---|
| Runs | L-1 | L-2 |
| RTD/mm $H_2O$ | 137 | 134 |
| DDI % | 22 | 22 |
| Adsorbent/mg | 101 | 101 |
| Surface Area, $m^2/g$ | 1100 | |
| Cellulose Acetate Replaced/mg | −28 | −21 |
| Gas phase components | | |
| Carbon Dioxide | | |
| Propene | −34% | |
| Hydrogen Cyanide | −35% | −30% |
| Ethane | −23% | |
| Propadiene | −46% | |
| 1,3-Butadiene | −67% | −41% |
| Isoprene | −85% | −68% |
| Cyclopentadiene | −83% | −66% |

TABLE 2G-continued

| | | |
|---|---|---|
| 1,3-Cyclohexadiene | −90% | −81% |
| Methyl Cyclopentadiene | −88% | −78% |
| Formaldehyde | −67% | −69% |
| Acetaldehyde | −76% | −63% |
| Acrolein | −78% | −71% |
| Acetone | −88% | −83% |
| Diacetyl | −92% | −88% |
| Methyl ethyl ketone | −93% | −90% |
| isovaleraldehyde | −89% | −77% |
| Benzene | −90% | −81% |
| Toluene | −92% | −84% |
| 1-Butyl nitrite | −91% | −84% |
| Methyl Furan | −88% | −78% |
| 2,5-dimethyl Furan | −92% | −86% |
| Hydrogen Sulfide | −30% | |
| Carbonyl Sulfide | −27% | |
| Methyl Mecaptan | −37% | −34% |
| 1-Methyl Pyrrole | −92% | −86% |
| Ketene | −61% | −35% |
| Acetylene | | −35% |

*Reduction measured from Puff by Puff Multoplex GC/MS method; Shown as blanks when the absolute reduction values are less than 30% and 3 sigma.

TABLE 3A

| SAMPLE # | Filter | AA | HCN | MEOH | ISOP |
|---|---|---|---|---|---|
| 1R4F | Ave. *1000 /TPM | 41 | 6.6 | 5.7 | 26.9 |
| | RSTD | 9% | 8% | 16% | 6% |
| 9617-7142 | XAD-16 hp | −8% | −18% | −31% | −36% |
| 9617-7144 | | −17% | −15% | −27% | −48% |
| 9617-7123 | SP825L | −2% | 6% | −25% | −56% |
| 9617-7125 | | −10% | 5% | −27% | −62% |
| 9617-7133 | SP850 | −9% | 6% | −31% | −61% |
| 9617-7135 | | −14% | 8% | −31% | −69% |
| 9617-7114 | L-493 | −56% | −21% | −84% | −85% |
| 9617-7115 | | −52% | 2% | −75% | −82% |
| 9617-7152 | V-502 | −37% | −17% | −46% | −52% |
| 9617-7154 | | −39% | −10% | −46% | −54% |
| 9617-7163 | V-493 | −63% | −33% | −62% | −82% |
| 9617-7165 | | −62% | −23% | −70% | −79% |

*Reduction from FTJR data based on Per TPM delivery of Gas Phase Components
AA = acetaldehyde
HCN = hydrogen cyanide
MEOH = methanol
ISOP = isopropanol

TABLE 3B

| SAMPLE # | Filter | TPM/Puff | TPM | PUFF | BI | DDI | RTD | Resin/mg | CA/mg |
|---|---|---|---|---|---|---|---|---|---|
| 1R4F | Ave.*1000 /TPM | 1.46 | 13.0 | 8.9 | 8.4 | 25.5 | 134.0 | 0 | Control |
| | RSTD | 4% | 4% | 3% | 6% | 8% | 1% | | |
| 9617-7142 | XAD-16hp | 1.32 | 13.2 | 10 | 9 | 30 | 120 | 101 | −14 |
| 9617-7144 | | 1.41 | 12.7 | 9 | 8 | 28 | 125 | 101 | −14 |

TABLE 3B-continued

| SAMPLE # | Filter | TPM/Puff | TPM | PUFF | BI | DDI | RTD | Resin/mg | CA/mg |
|---|---|---|---|---|---|---|---|---|---|
| 9617-7123 | SP825L | 1.37 | 12.3 | 9 | 8 | 28 | 133 | 101 | −28 |
| 9617-7125 | | 1.38 | 12.4 | 9 | 8.5 | 24 | 146 | 101 | −21 |
| 9617-7133 | SP850 | 1.27 | 11.4 | 9 | 8.4 | 29 | 135 | 100 | −14 |
| 9617-7135 | | 1.26 | 11.3 | 9 | 8.5 | 25 | 147 | 101 | −14 |
| 9617-7114 | L-493 | 1.38 | 11.9 | 8.6 | 7.9 | 30 | 132 | 101 | −21 |
| 9617-7115 | | 1.34 | 12.1 | 9 | 8.5 | 24 | 146 | 101 | −21 |
| 9617-7152 | V-502 | 1.54 | 13.9 | 9 | 8.6 | 27 | 102 | 100 | −28 |
| 9617-7154 | | 1.63 | 14.7 | 9 | 7.9 | 23 | 112 | 100 | −35 |
| 9617-7163 | V-493 | 1.56 | 14 | 9 | 7.9 | 24 | 150 | 101 | −35 |
| 9617-7165 | | 1.47 | 13.2 | 9 | 8 | 30 | 115 | 100 | −35 |

*Reduction from FTJR data based on Per TPM delivery of Gas Phase Components

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A cigarette filter comprising an unfunctionalized porous polyaromatic resin, wherein the unfunctionalized polyaromatic resin is capable of removing at least some of at least one gas phase constituent from mainstream smoke through sorption.

2. The cigarette filter of claim 1, wherein the unfunctionalized porous polyaromatic resin is a polymerization product of non-polar styrene and divinyl benzene.

3. The cigarette filter of claim 1, wherein the unfunctionalized porous polyaromatic resin is more hydrophobic than activated carbon.

4. The cigarette filter of claim 1, wherein the unfunctionalized porous polyaromatic resin has a surface area of at least 500 $m^2$/gram.

5. The cigarette filter of claim 4, wherein the unfunctionalized porous polyaromatic resin has a surface area of at least 750 $m^2$/gram.

6. The cigarette filter of claim 5, wherein the unfunctionalized porous polyaromatic resin has a surface area of at least 1000 $m^2$/gram.

7. The cigarette filter of claim 6, wherein the unfunctionalized porous polyaromatic resin has a surface area of at least 1500 $m^2$/gram.

8. The cigarette filter of claim 1, wherein the unfunctionalized porous polyaromatic resin has a mean pore diameter from about 20 Å to about 1000 Å.

9. The cigarette filter of claim 1, wherein the unfunctionalized porous polyaromatic resin has a pore volume from about 0.1 mL/g to about 2.0 mL/g.

10. The cigarette filter of claim 1, wherein the unfunctionalized porous polyaromatic resin is in the form of beads that are from about 50 $\mu$m to about 3000 $\mu$m in size.

11. The cigarette filter of claim 10, wherein the unfunctionalized porous polyaromatic resin is in the form of beads that are from about 100 $\mu$m to about 2500 $\mu$m in size.

12. The cigarette filter of claim 11, wherein the unfunctionalized porous polyaromatic resin is in the form of beads that are from about 250 $\mu$m to about 1500 $\mu$m in size.

13. The cigarette filter of claim 1, the at least one gas phase constituent is selected from the group consisting of dienes, furans, pyrroles, aromatics and ketones.

14. The cigarette filter of claim 1, wherein the at least one gas phase constituent is selected from the group consisting of propene, hydrogn cyanide, propadiene, 1,3-butadiene, isoprene, cyclopentadiene, 1,3-cyclohexadiene, methyl cyclopentadiene, formaldehye, acetaldehyde, acrolein, acetone, diacetyl, methyl ethyl ketone, cyclopentanone, benzene, toluene, acrylonitrile, methyl furan, 2,5-dimethyl furan, hydrogen sulfide, carbonyl sulfide, methyl mercaptan, and 1-methyl pyrrole.

15. The cigarette filter of claim 14, wherein the at least one gas phase constituent is selected from the group consisting of formaldehyde, acetaldehyde, acrolein, methanol, hydrogen sulfide, carbonyl sulfide and methyl mercaptan.

16. The cigarette filter of claim 1, wherein the unfunctionalized porous polyaromatic resin selectively removes formaldehyde, acetaldehyde, acrolein and methanol from mainstream tobacco smoke.

17. The cigarette filter of claim 1, wherein the unfunctionalized porous polyaromatic resin selectively removes hydrogen sulfide, carbonyl sulfide and methyl mercaptan from mainstream tobacco smoke.

18. The cigarette filter of claim 1, wherein the unfunctionalized porous polyaromatic resin is present in an amount effective to remove at least 50% of at least one gas phase constituent in mainstream tobacco smoke.

19. The cigarette filter of claim 1, wherein the cigarette filter comprises from about 5 mg to about 300 mg of the unfunctionalized porous polyaromatic resin.

20. The cigarette filter of claim 19, wherein the cigarette filter comprises from about 75 mg to about 225 mg of the unfunctionalized porous polyaromatic resin.

21. The cigarette filter of claim 1, wherein the cigarette filter has low resistance-to-draw.

22. The cigarette filter of claim 1, wherein the cigarette filter has high total particulate matter delivery.

23. The cigarette filter of claim 1, wherein the unfunctionalized porous polyaromatic resin further comprises at least one flavorant.

24. The cigarette filter of claim 1, wherein the filter is attached to a tobacco rod by tipping paper.

25. The cigarette filter of claim 1, wherein the unfunctionalized porous polyaromatic resin is incorporated in one or more cigarette filter parts selected from the group consisting of tipping paper, shaped paper insert, a plug, a space, or a free-flow sleeve.

26. A cigarette filter of claim 1, wherein the unfunctionalized porous polyaromatic resin is incorporated in a mono filter, a dual filter, a triple filter, a cavity filter, a recessed filter or a free-flow filter.

27. A cigarette comprising the cigarette filter of claim 1.

28. The cigarette of claim 27, wherein the cigarette is an electrical cigarette.

29. A method of making a cigarette filter, comprising incorporating an unfunctionalized porous polyaromatic resin into a cigarette filter, wherein the unfunctionalized porous polyaromatic resin is capable of removing at least some of at least one constituent in mainstream tobacco smoke through sorption.

30. A method of making a cigarette, the method comprising:

(i) providing a cut filler to a cigarette making machine to form a tobacco rod;

(ii) placing a paper wrapper around the tobacco rod; and (iii) attaching the cigarette filter of claim 1 to the tobacco rod using tipping paper to form the cigarette.

31. A method of smoking the cigarette of claim 27, comprising lighting the cigarette to form smoke and drawing the smoke through the cigarette, wherein during the smoking of the cigarette, the unfunctionalized porous polyaromatic resin removes at least some of at least one constituent in mainstream tobacco smoke through sorption.

32. A method of smoking the cigarette of claim 28, comprising lighting the cigarette to form smoke and drawing the smoke through the cigarette, wherein during the smoking of the cigarette, the unfunctionalized porous polyaromatic resin removes at least some of at least one constituent in mainstream tobacco smoke through sorption.

* * * * *